United States Patent [19]

Newsome et al.

[11] 4,022,455

[45] May 10, 1977

[54] DEMOGRAPHIC ASSEMBLING AND ADDRESSING MACHINE FOR MAGAZINES AND THE LIKE

[75] Inventors: John R. Newsome, Shumway; Kenneth Polarek, Effingham; Frederick F. Nasser, Teutopolis, all of Ill.

[73] Assignee: World Color Press, Inc., Maryland Heights, Mo.

[22] Filed: Dec. 31, 1975

[21] Appl. No.: 645,875

[52] U.S. Cl. ..... 270/54

[51] Int. Cl.[2] ..... B65H 39/02

[58] Field of Search ..... 270/54–55, 270/58–60

[56] References Cited

UNITED STATES PATENTS

| | | | |
|---|---|---|---|
| 3,206,043 | 9/1965 | Kile | 270/54 |
| 3,608,888 | 9/1971 | McCain | 270/54 |

*Primary Examiner*—Edgar S. Burr
*Assistant Examiner*—A. Heinz
*Attorney, Agent, or Firm*—Leydig, Voit, Osann, Mayer & Holt, Ltd.

[57] ABSTRACT

An assembling and addressing machine for magazines which are differently assembled in a number of different versions for sending to individuals falling into different demographic categories based upon interest, occupation or the like. A plurality of signatures are produced which are capable, upon selection in predetermined combinations, of accommodating all of the different versions. A gathering device gathers the selected signatures to form a book. Books in various versions are stored in temporary storage stations. The device operates under the control of address labels which include the address and indication of the demographic category. Means are provided for reading the category and for triggering release of a book from the corresponding storage station and to which the label is then applied. It is one of the features of the invention that means are provided in each storage station for sensing depletion and for signaling the gathering device to produce a group of books to replenish the depleted station. The temporary storage stations are in the form of conveyor belts arranged side by side and having hoppers at the output with individual dispensing means. Delay devices, preferably including memory, are interposed between a point where a given book is acted upon and a point of upstream release so that books may flow in unbroken series. Means are provided for calipering each book immediately following gathering of signatures with means for readjusting the caliper depending upon the version of book being measured. Automatic means are provided for insertion of cards into the book at the order of the address label.

14 Claims, 8 Drawing Figures

DEMOGRAPHIC ASSEMBLING AND ADDRESSING MACHINE FOR MAGAZINES AND THE LIKE

It is known to publish magazines in different geographic versions, with specialized articles and advertising suited to the interests of subscribers in defined portions of the country. It has been recognized for some time that it would be desirable to be able, on an economical basis, to furnish magazines in different "demographic" versions suited to the profession, occupation or special interest of the subscriber. For example, in the case of a magazine normally considered to be of general interest but which is sent to subscribers in different professions or occupations such as business people, doctors, lawyers, farmers, etc., it would be desirable to fit the publication to the subscriber's interest. In the case of different geographic revisions the procedure is relatively simply since the different versions can be assembled and addressed in groups corresponding to zip code groupings. However, the magazines cannot be assembled and addressed in demographic groupings since it is necessary, to qualify for a reasonable postal rate, for magazines to reach the labeling table grouped in accordance with postal destination. Magazines intended for a common destination are handled, by automatic means, in groups of twenty but in no event less than six. It will be apparent that necessity for grouping in accordance with zip codes makes it impossible to group successive books by demographic designation to achieve a run, of reasonable length, of similar books.

In short, any assembling and addressing machine intended for producing a magazine in different demographic versions from an inventory of reasonable size must be capable of feeding a book singly, on immediate call, in any desired version.

It is, accordingly, an object of the present invention to provide an assembling and addressing machine capable of automatic production and addressing of magazines in a plurality of demographic versions, with capability of furnishing individual books of predetermined versions in any order or in any mix in accordance with instructions on the address label and at a high production rate. It is a related object to provide a machine for assembling and addressing magazines in which the address label not only serves to select a magazine of a demographic version specifically intended for a particular addressee but which is capable of utilizing instructions from successive address labels grouped by zip code number quite independently of the demographic category of the addressee. Indeed, it is an object to provide an assembling and addressing machine in which successive books are selected in accordance with demographic information appearing on a series of address labels completely independently of the order in which address labels are arranged.

It is another object of the present invention to provide an assembling and addressing machine which is required to feed books to a labeling table, for mating with labels received at the labeling table, and with the books being furnished one by one, in accordance with instructions on the individual address labels, but which nevertheless includes a gathering device which produces each demographic version in groups consisting of a series of identical books thereby reducing, to a reasonable level, the number of switches of the gathering device between different predetermined combinations of signatures.

It is a general object, related to the foregoing, to provide a gathering device for producing books in groups of identical units on a high speed basis, a labeling table to which books of different versions are fed individually on call and which includes a temporary or "buffer" storage assembly interposed between the gathering device and labeling table to insure that the needs of the labeling table are reliably met. It is a related object to provide an automatic assembling and addressing machine for magazines and the like having provision for buffer storage but in which relatively few units are, at any given time, tied up as inventory in the storage facility.

It is another object of the present invention to provide a gathering device, storage assembly and labeling table and in which a label orders the storage device to feed a book, but in which the storage assembly instructs the gathering device to make up a series of books for replenishment purposes, with the books being subsequently directed to the appropriate storage station, the three functions being carried on automatically in a coordinated fashion so as to keep the storage assembly constantly occupied with an inventory of books at a reliable minimum level. It is a more specific object to provide memory type delay devices to insure mating of an address label with a book of the demographic version called for by the address label and to assure acceptance, at a particular storage station, of each book intended for such storage station and timed with arrival of the book at the storage station. Because of the flexibility provided by the delay devices, books may be in constant closely spaced flow throughout the machine.

It is another object to provide, in a machine of the above type, a temporary or "buffer" storage assembly made up of storage stations in the form of a plurality of storage conveyor belts spaced parallel to one another and extending laterally between input and output conveyors for respectively receiving and dispensing books and in which means are provided for keeping a running register of the number of books in each of the storage stations as a criterion for automatic replenishment.

It is an object of the invention in one of its aspects to provide gathering device having means for producing a plurality of printed signatures capable upon selection, in predetermined combinations, of accommodating a number of different demographic versions, and having a caliper at the output for measuring the thickness of each of the resulting books, with means for adjusting the setting of the caliper in accordance with the demographic identification of the book being measured and with provision for rejecting the book when the thickness does not correspond to the setting of the caliper, indicating that the book is incomplete. It is, in other words, an object to provide an assembling and addressing machine including a gathering device capable of gathering signatures in various combinations to produce a number of demographic versions of the same magazine but with insurance that each book within each demographic category is of predetermined thickness thereby to insure identical make-up.

More generally stated, it is an object of the present invention to provide an automatic assembling and addressing machine for magazines and the like published in a number of demographic versions in which single magazines are "on call" on an individual basis, which gathers the magazines at high speed in identical groups from an inclusive set of printed signatures but which is, nevertheless, relatively simple and inexpensive, capable of operating trouble-free for long periods of time with minimal supervision and highly flexible in usage, being capable of conversion from one magazine to the next with minimum set-up time, and which is inherently compact, occupying less square footage than machines not having buffer storage capacity.

Other objects and advantages of the invention will become apparent upon reading the attached detailed description and upon reference to the drawings in which.

Figure 6:
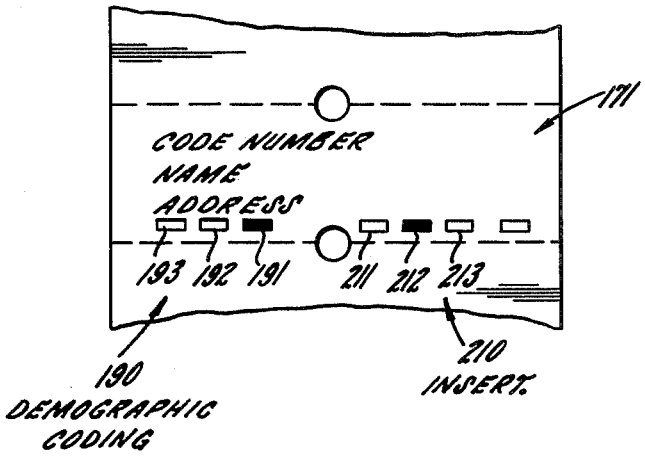
FIG. 6 shows a typical address label with demographic coding thereon.
Figure 6A:
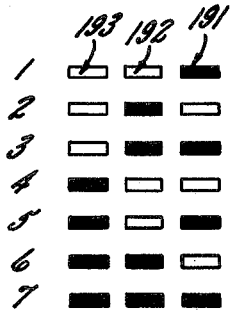

FIG. 6*a* sets forth the nature of the coding.

Figure 7:
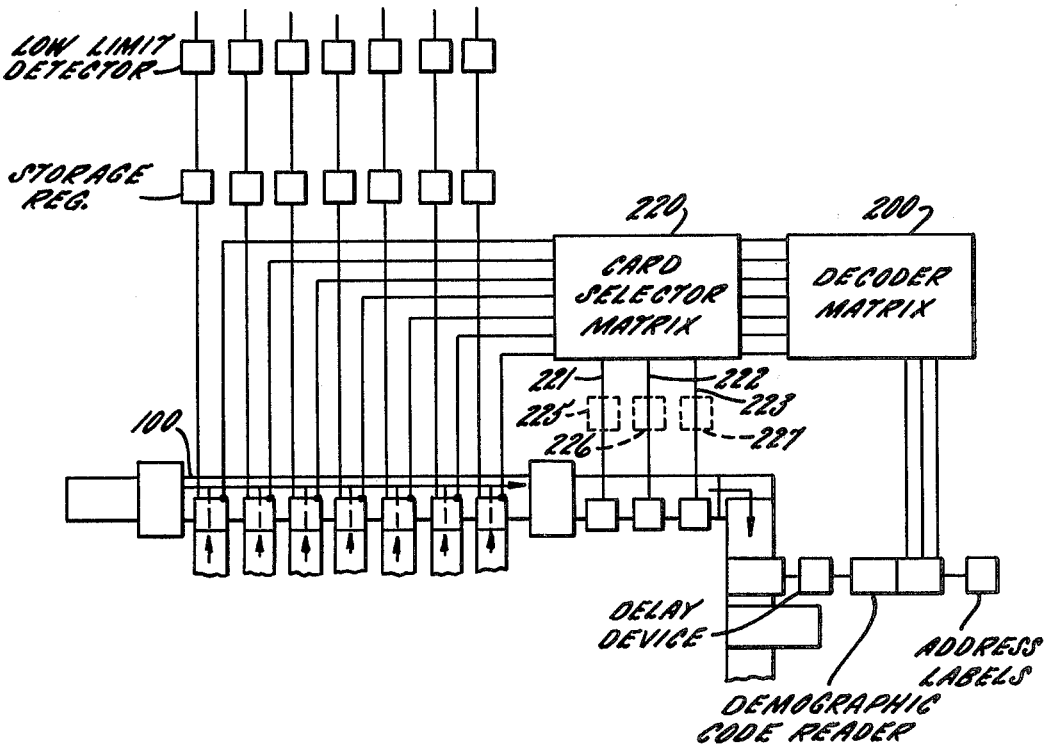

FIG. 7 shows an alternate form of the invention providing for card selection in accordance with demographic coding.

While the invention has been described primarily in connection with a preferred embodiment, it will be understood that it is not our intention to be limited to the particular embodiment shown but it is our invention, on the contrary, to cover the various alternative and equivalent forms of the invention included within the spirit and scope of the appended claims.

Figure 1:
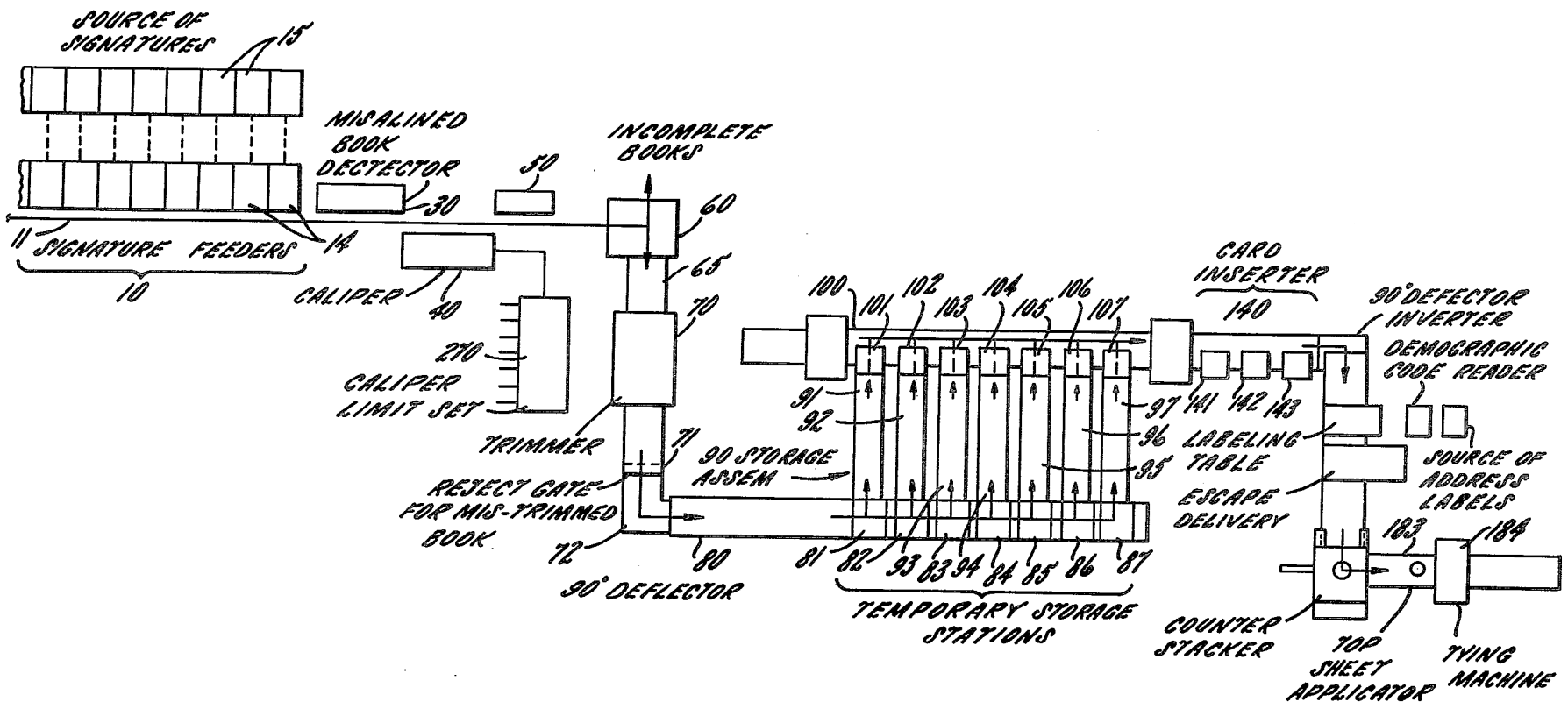
FIG. 1 is a plan view of an assembling and addressing machine constructed in accordance with the present invention and diagrammatically showing the layout of the mechanical components.
Figure 2:
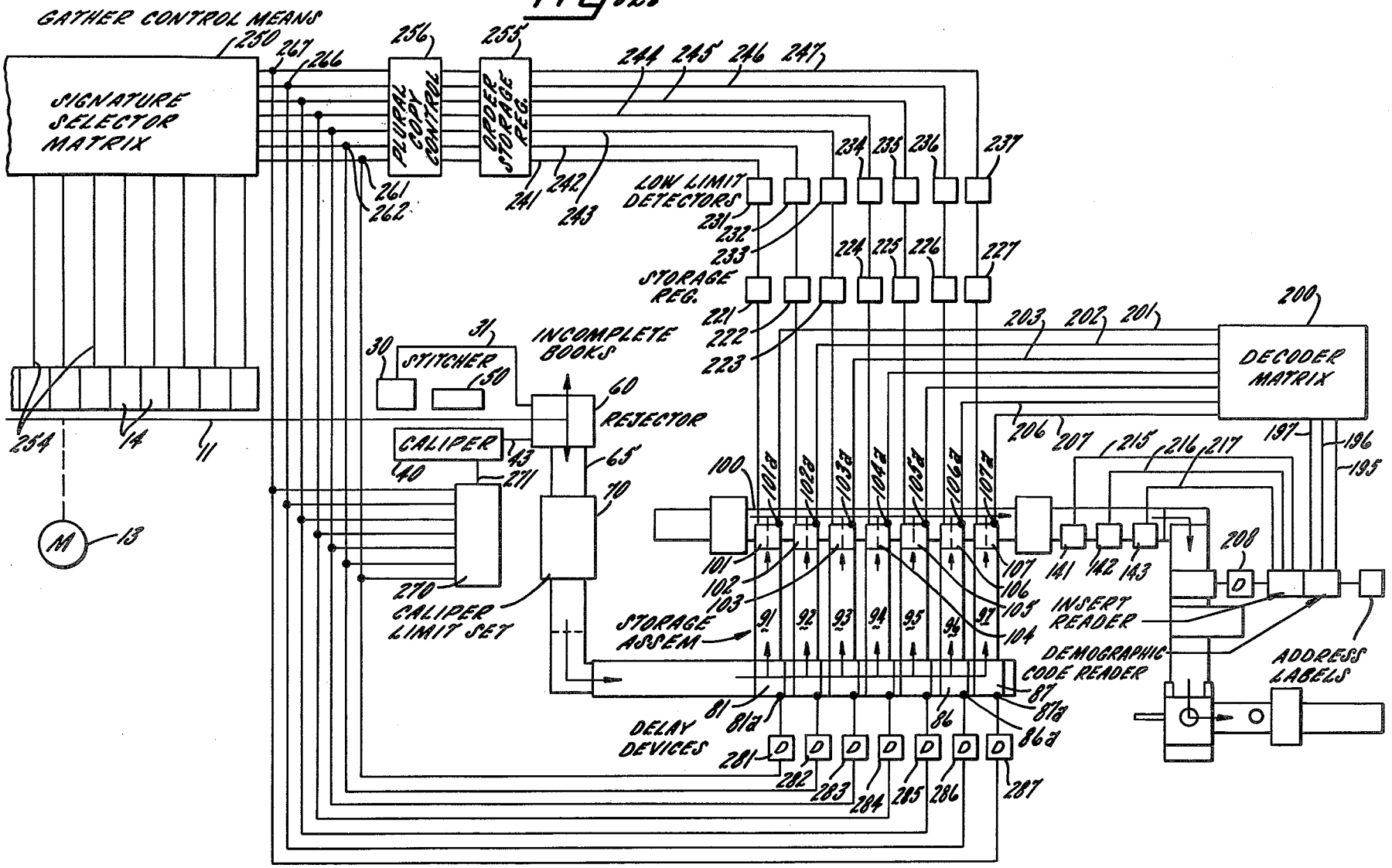
FIG. 2 is a view similar to FIG. 1 but with a schematic control diagram superimposed thereon showing feedback control loops enabling continuous unsupervised operation.
Figure 3A:
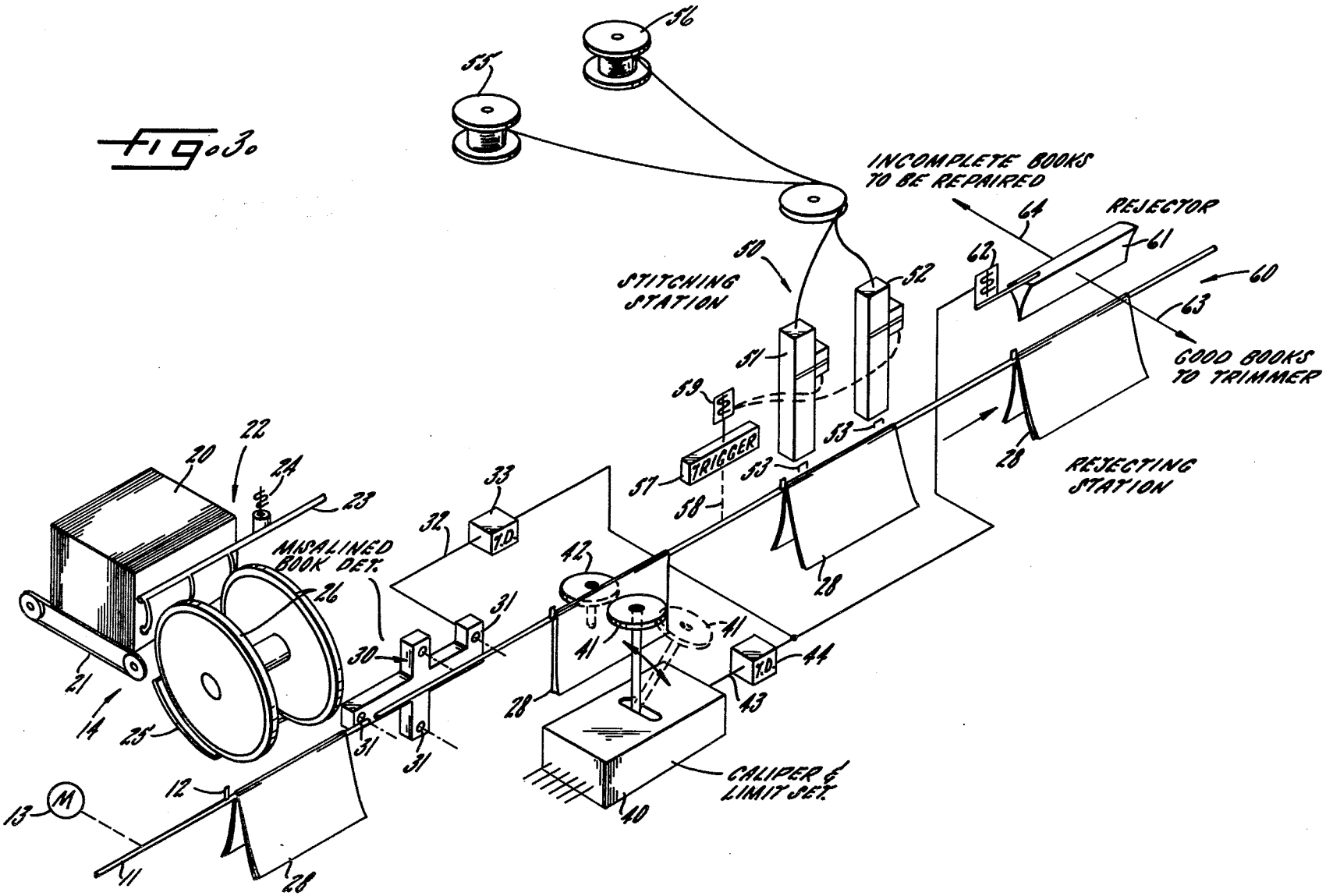
FIG. 3 is a perspective diagram showing a signature feeder comprising an element of the gathering device together with a misaligned book detector, caliper, stitcher and rejector.

Turning now to the drawings, and particularly to the left-hand portions of FIGS. 1–3 there is shown a gathering device 10 having a conveyor 11 with a spaced signature-engaging lugs 12, the conveyor being driven by a suitable drive 13. A plurality of signature feeders 14 are arranged along the side of the conveyor 11 and to which signatures are supplied from individual sources 15. The sources 15, it will be understood, are supplied with respective printed signatures from a press, or series of presses.

The signature feeders 14 are per se well known in the art, a typical construction being illustrated diagrammatically in FIG. 3. The stack of signatures, indicated at 20, are supported, vertically-edgewise, upon a conveyor belt 21, with the forwardmost signature adjacent a vacuum feed device 22. The feed device is connected to a vacuum line 23 via an interposed solenoid valve 24. Upon energization of the solenoid valve a typical signature 25 is fed by transfer discs 26 and dropped "tent fashion", that is, open side down, upon the conveyor 11 for engagement by a lug 12.

By employing a plurality of the devices 14, side by side, along the conveyor, each adapted to deposit a single signature, upon command, upon the conveyor, a set of signatures will be progressively gathered forming a completed magazine or "book". It will be understood in carrying out the invention that not all of the signatures are utilized in the forming of each book; instead, means are provided for energizing the control valves 24 in predetermined combinations for producing a book which consists of only certain selected ones of the signatures which, together, form a predetermined demographic version. The means for triggering the valves 24 in the predetermined combinations will be referred to at a later point in connection with the control diagram which is schematically illustrated in FIG. 2. It will be assumed that the signature feeder 14 illustrated in FIG. 3 is the terminal one of a series of such feeders so that the collection of signatures, indicated at 28, will be complete.

In order to insure that all of the signatures are properly alined with another, the unbound book 28 next passes in front of a "misalined book" detector 30 having photocells 31 which are spaced from one another to conform to the page size, and with selective blockage of the photocells being utilized as an indication that the signatures are not alined, but on the contrary are out of register, requiring subsequent rejection, any rejection signal being transmitted via a line 32 which includes a time delay device 33. The means for detecting misalinement and generating a rejection signal will be understood to be well known in the art, cross reference being made to the available literature.

Upon continued movement of the conveyor 11, the gathered signatures are moved into engagement with a caliper 40 having a caliper head roller 41 cooperating with a backstop roller 42 and with the spacing between the rollers, upon bottoming against the gathered signatures, being a direct measure of thickness. In the event that the thickness exceeds, or is less than, the amount for which the device has been set, indicating an improperly constituted book, a signal is sent out on a line 43 via a time delay device 44 to trigger rejection. The caliper device 40 has been set forth only diagrammatically since such devices, capable of triggering subsequent rejection of the out-of-tolerance book of signatures, are per se well known and commercially available. In carrying out the present invention the caliper 40 includes, as a novel feature, capability of being set, by electrical means, in any one of a series of predetermined reference thickness settings corresponding to books of different demographic version, as will be discussed.

The gathered signatures, following calipering, are then transmitted into a stitching station 50 having a pair of stitching devices 51, 52 for applying a pair of staples 53 which secure the gathered signatures together along the binding edge. The staples, it will be understood, are cut and formed within the individual stitching devices from lengths of wire fed from supply rolls 55, 56. The stitching operation may, as a practical matter, be initiated by a trigger 57 actuated by the conveyor through a connection 58, the triggering signal serving to energize an electric solenoid 59 which is mechanically connected to the stitching devices to operate them in unison. It will be understood that the stitching device 50, which has only been diagrammatically shown does not per se form an element of the present invention and reference is made, for further details of such a device, to the published literature.

Upon continued movement of the conveyor the book, now held together by stitching, passes into a rejecting station 60. The rejecting station includes a rejector vane 61 operated by a solenoid 62 and which includes means (not shown) for causing a book 28 to be discharged forwardly along path 63 under normal conditions as well as means for causing the book to be ejected rearwardly along path 64 when the solenoid 62 is energized as a result of a signal either from the output line 32 of the misalined book detector 30 or from the output line 43 of the caliper 40. The time delay device insures that rejection occurs synchronously with arrival of the defective book. It will be understood that rejectors are per se known in the art so that the details need not be described. Any rejected book, passing rearwardly along path 64, is retrieved and manually reassembled while the main flow of books occurs normally along path 63 for discharge upon a second conveyor 65 which extends at 90° to the first conveyor, and which may be coupled to the same driving means 13. The books passing along the conveyor 65 are next acted upon by a trimming device 70 which will be understood to the conventional and which trims and squares the edges of the volume. As is known in the art, means may be provided for checking the trimmed volume and for rejecting any found to be mis-trimmed at a gate 71.

The books which successfully pass the gate next flow through a 90° deflector 72 which causes each book, in order, to be turned at right angles. The structure of the device for accomplishing this is per se well known in the art and consequently more detailed illustration is unnecessary.

In carrying out the present invention the books next move to a temporary or "buffer" storage assembly via an "input" conveyor 80 having a series of diverters or gates 81–87 which are selectively actuatable to deposit an arriving book in a corresponding storage station. The conveyor 80 consists of a pair of conveyor elements 84 (FIG. 4) which may, with the other conveyors, be powered by a common drive motor 13 (FIG. 3). The gates 81–87 are actuated by correspondingly numbered replenishment solenoids **81*a*–87*a*** which are energized by means to be discussed.

From the conveyor 80, depending upon the gate which is energized, books are stored in storage stations, in the present instance seven in number, indicated at 91–97, respectively. As will be seen, means are provided for dispensing a stored book, on call, from one of the storage stations so that the dispensed book flows along an "outlet" conveyor, the outlet conveyor being indicated at 100 and the respective dispensing means at 101–107.

Figure 4:
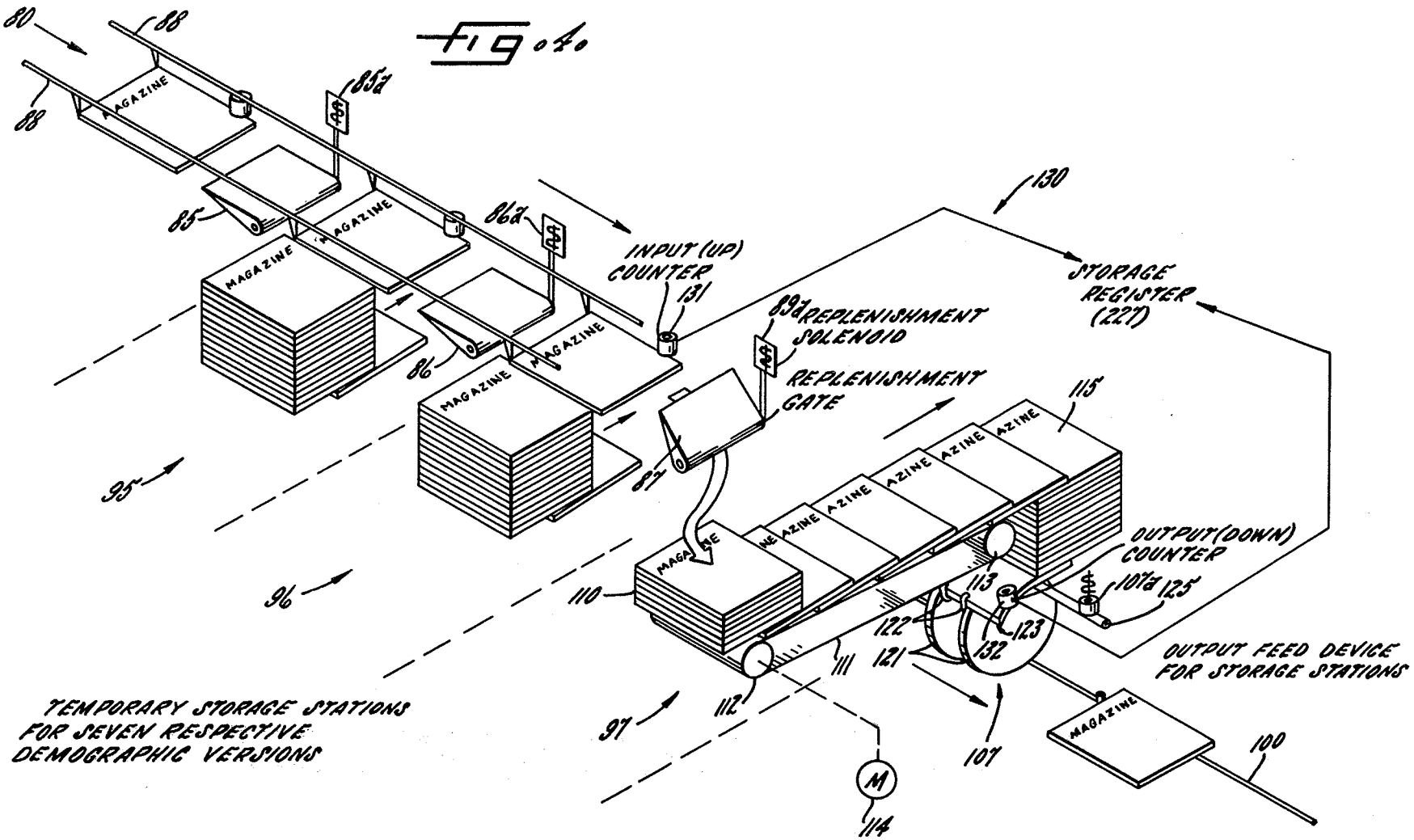
FIG. 4 is a perspective view showing a typical temporary storage station and associated input and output conveyors.

All of the temporary storage stations are identical so that the construction may be understood by considering one of them, the one which is shown at 97 in FIG. 4. When the vane, or gate, 87 is deflected by the replenishment solenoid **87*a*, the books, arriving seriatim, drop upon an inlet stack 110 in the station at the beginning of a lateral conveyor 111 which may be in the form of a belt mounted upon rollers 112, 113 driven by a motor 114. The volumes are conveyed in shingled formation from the bottom of the stack 110 and, at the dispenser end, are deposited in a hopper 115. For the purpose of feeding a book, upon call, from the bottom of the hoppers, dispensers 101–107 each have a pair of transfer discs 121 carrying corresponding grippers 122. Feeding is initiated by respective vacuum feed devices 123, with solenoid valves 101*a*–107*a* controlling application of vacuum to such devices from evacuated line 125**. For a more detailed disclosure of a typical vacuum feed device, reference is made to the published literature.

It is one of the features of the present device that books are gathered, not singly, but in a series of identical volumes. When the series arrives on conveyor 80 it is deposited in a temporary storage station by actuation of the appropriate gate or deflector, the books dropping upon the input stack 110. Those books in the stack 110, those in shingled relation of the station conveyor belt 111, and those in the output hopper 115, taken together, form the stored reservoir or inventory, which in a practical case may be a maximum of seventy books per station.

For the purpose of keeping a constant and up-to-date tally of the books stored in a particular station, a register system is provided which makes use of an input counter and an output counter, with the inventory count being the difference between the two. Thus in the present instance, each storage station has a counting system 130 including an input counter diagrammatically illustrated at 131 which counts the books which are diverted downwardly into the station, by the gate 87. A second counter 132 is provided at the associated dispenser 107 for counting the books which pass from the station 97 onto the outlet conveyor belt 100. The counters 131, 132 are both connected to a storage register in such a way that the register tallies an "up" count for each impulse received from the in counter 131 and a "down" count for each impulse received from the out counter 132. As will be discussed, means are associated with the storage register for responding to a low threshold limit condition to call for replenishment of the books in a particular station, the threshold, in the case of a seventy book maximum, being, say, 30 books.

While the drive for the output conveyor 100 has not been mechanically illustrated, it will be understood that such conveyor may be coupled to the same driving source 13 as the input conveyor.

Figure 5:
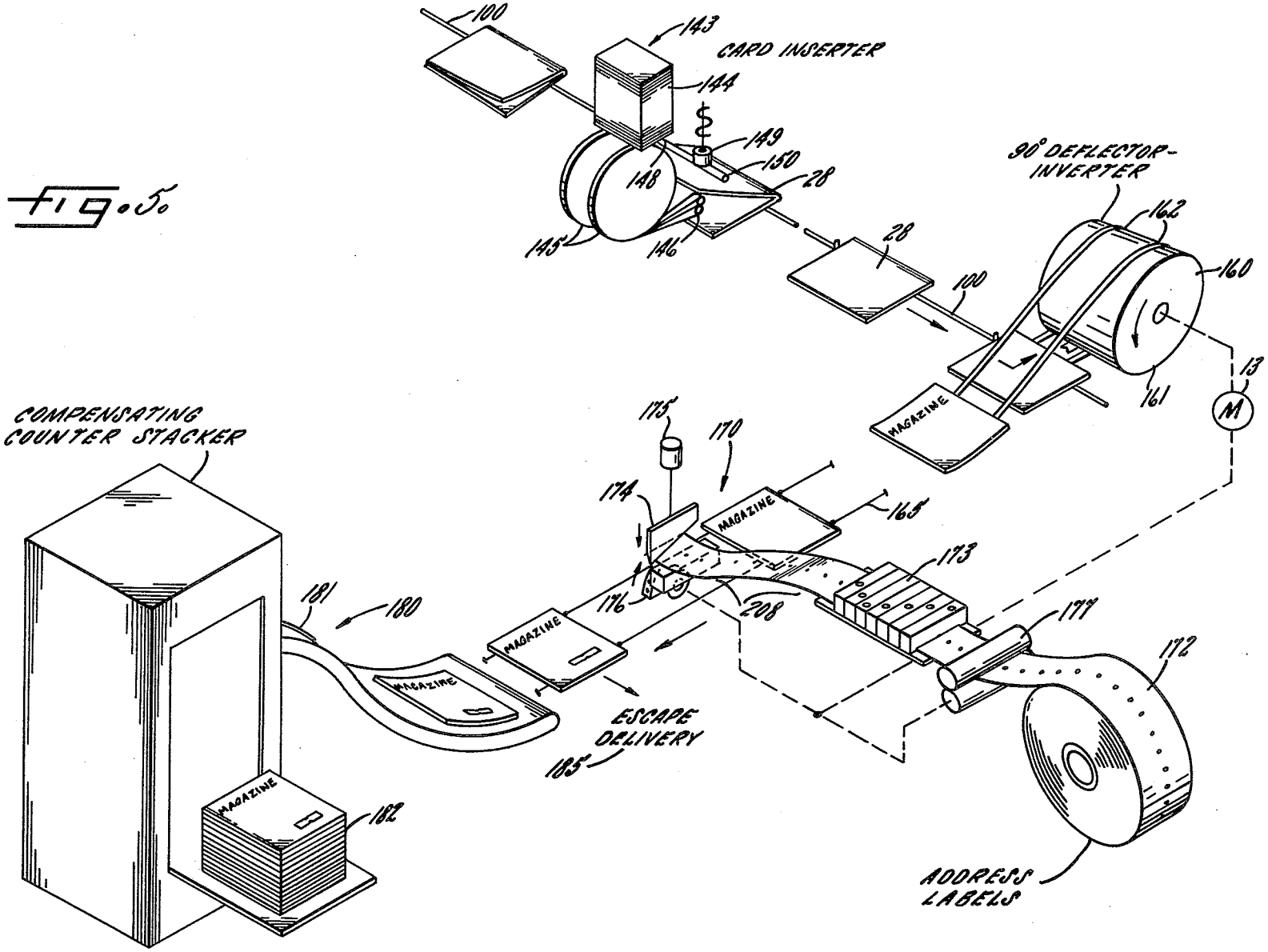
FIG. 5 is a perspective view showing a typical card inserted with means for reading and applying a series of address labels to books of predetermined demographic version and for subsequently stacking the same for bundled discharge.

The books passing along the conveyor 100 next flow through a card inserting station 140 having card inserters 141, 142, 143. Referring to FIG. 5 which shows the final card inserter 143, it will be seen that the inserter includes a stack of cards 144, transfer discs 145, and an injector 146. Injection takes place into the opened book, the book being cammed apart to separate the pages by means which does not form a part of the present invention. For initiating the feeding of a card a vacuum device 148 is employed under the control of a solenoid valve 149 which is connected to a vacuum line 150. The present invention is not, however, limited to the particular form of inserter which has been diagrammatically illustrated but includes the possibility of using any commercially available type of inserter capable of being triggered by an electric control signal. The invention does, however, relate to the means for triggering the operation of the three card inserters on the basis of information included on the address label, as will be discussed.

The book 28 (FIG. 5) with cards inserted, next passes into a 90° deflector-inverter 160 which may include the drum 161 having guide strips 162. The books 28 are fed, by conveyor 100, into the nip between guide strips and drum. Each book, thus held captive, passes around the drum being deposited upon a final conveyor 165 in a direction going at 90° and with the book in face-up position. The conveyor is preferably driven by, or synchronized with, the main conveyor driver 13.

The books are thus conveyed, one by one, to a labeling table 170 where a label of the form shown in 171 in FIG. 6 is applied. Such labels are fed from a pre-printed roll 172 through a scanner or code reading device 173 to a cutter blade 174 having an actuator 175. Each address label, following severence, is applied, or mated, to the passing book by means of an applicator 176. The tape is driven by rollers 177, preferably synchronized with the drive 13. It will be understood that the means for furnishing address labels from a continuous roll and the means for severing and applying an address label to a magazine passing across the labeling table are per se well known and available in the art and consequently have not been illustrated in detail.

The books, with labels attached, next pass into a counter-stacker 180 having an inlet 181 and which delivers books in a pile 182 grouped for sending to the same destination. A top sheet is added by a top sheet applicator 183 which sets forth the destination and the bundle is tied and sealed in a tying machine 184. In the event that there are not enough books to form a bundle of adequate size, such books are directed into an escape delivery indicated at 185 (FIG. 5).

In accordance with the present invention, each address label includes indication, in coded form, of the demographic category of the recipient and means are provided, responsive to the reading or scanning device 173, for triggering the dispensing means of the storage assembly for feeding of a book of matching category from the corresponding storage station for conveyance to the labeling table where the label is applied. In the preferred form of the invention the coded field 190 (FIG. 6) includes three "dot" positions 191, 192, 193. Depending upon whether the "dots" are inked or non-inked they form a binary code as set forth in FIG. 6*a*. For the details of a dot reading device, reference is made to the publications and technical data of manufacturers of such equipment including Edwin Sick of Waldkirch, West Germany.

The presence of an ink dot produces a signal on respective lines 195, 196, 197 which provide the input to a decoder matrix 200 having output lines 201–207, the latter leading to solenoid valves 101*a*–107*a* which control the dispensers 101–107 in corresponding ones of the storage stations. By way of example, when a signal appears on line 195, but not on the other two lines, output line 201 is energized for feeding of a book from storage station 91. When a signal only appears on reader line 196, a book is dispensed from storage station 92, etc., corresponding to the binary coding set forth in FIG. 6*a*. In short, each address label calls for a book in a predetermined demographic category by reason of the coded interest of the recipient. In order to insure that the address label, calling for a particular version of book, is mated with, and applied to, the book which has been called for, delay means is incorporated between the reader 73 on the one hand and the blade-applicator 174, 176 on the other. The amount of delay is determined by the length of the time that it takes for a dispensed book to arrive at the labeling table at the point where the label is applied. Such delay may be most simply obtained by coupling the tape drive rollers 177 to the main drive 13 for synchronization purposes and by providing an idle length of labeling tape between reader and applicator and which has been indicated at 208 in FIG. 5. Since the books arrive at the labeling table in the same order as the labels which triggered their release, the books may flow to the labeling table in a closely spaced series synchronized with arrival and application of the corresponding address label.

For the purpose of signalling insertion of the appropriate cards, a card insertion field 210 is provided on each label consisting of three spots 211, 212, 213 which, upon being "linked in", are, via lines 215, 216, 217, effective to trigger operation of the inserters 141, 142, 143, respectively. The means for reading the presence or absence of spots 211–213, incorporated in the reader 173, is preferably offset "downstream" by a small distance from the reading means for the demographic code so that the cards are inserted synchronously with the passage of the book for which they are intended.

Instead of providing special card insert spots on each address label, the insertion of cards may, if desired, be triggered automatically in accordance with the demographic category of a given book. This is accomplished as set forth in FIG. 7 in which the dispenser control lines 201–207 serve to operate a card selector matrix 220 having output lines 221–223 with interposed optional delay devices 225–227 providing slight additional time delay for the purpose of synchronizing insertion precisely with arrival of the book at the inserter station. While the specific circuit of the matrix 220 is not set forth, it will be understood that the matrix function, and and hence applicable circuitry, is conventional, triggering a signal in a given one of the output lines 221–223 in response to signals appearing on corresponding ones of the decoder matrix output lines 201–207. Just by way of example, in the event that the decoder output line 201 corresponds to a "medical" demographic category, the card selector and matrix will be wire to produce insertion into the ordered book a card of medical interest.

To summarize, then, the reading of a particular label, by the reader 173 in response to a particular demographic code grouping triggers release, from the storage assembly, of a book corresponding to the demographic category, into which cards are inserted corresponding to such category, and with the dispensed book being mated, at the labeling table, with the same label which triggered its release.

Upon successive calls being made upon any one of the storage stations, the number of books stored in the station will naturally be successively reduced. Means are provided, in accordance with one of the important aspects of the invention, for responding to the reaching of a lower threshold limit condition for instructing the gathering means to make up a series of books of corresponding demographic category for replenishment purposes and for causing such replenishment stock to be deposited in the corresponding storage station.

As shown schematically in FIG. 2, this is accomplished by providing the storge registers 221–227 for the respective storage stations with respective low limit detectors capable of producing an output signal when the number in the register falls below a predetermined level. The low limit detectors associated with the registers are indicated at 231–237, having output lines 241–247, respectively. The low limit detectors are of known construction so arranged that, when the threshold limit is reached, for example, a net count of 30 books, a replenishment signal appears on the corresponding one of the output lines.

For the purpose of triggering the signature feeders 14 in combinations appropriate to the demographic category of or versions of the books to be made up, gather control means are provided including a signature selector matrix 250 having output lines 254 leading to the respective signature feeders 14. While it has not been necessary to show the specific circuit employed in the selector matrix, it will be understood that the matrix per se is conventional and so arranged that a signal upon one of the input lines 241–247, corresponding to a given category, triggers the feeding of signatures in a particular and corresponding combination to form the version of book which is being called for.

It is possible, of course, that two or more of the storage stations may run low on books in quick succession. To take care of this possibility, an order storage register 255 is interposed in the replenishment lines 241–247 including memory circuitry permitting completion of the gathering of books in one category before the gathering device is instructed to collect books of another category. Such memory circuitry has not been specifically illustrated since devices are well known, and available in the art capable of taking instructions in quick succession on a plurality of input lines energizing corresponding output lines, in accordance therewith, on a timed release basis.

It is one of the features of the present assembling and addressing machine that books in a given demographic category are gathered, not singly, but in groups of a certain minimum number thereby minimizing the number of switches that the gathering device is called upon to execute and enabling an increase in gathering speed. For example, the low limit detectors associated with the storage registers for each of the storage stations may be set to provide an output signal upon the inventory in the storage station dropping to a point which is, say, forth below the maximum number which can be accommodated in the storage station. Means may be correspondingly provided, then, for making up, or gathering, a series of forty identical books, all of which are directed to the partly depleted storage station for replenishment purposes. This is accomplished, in the present instance, by providing a plural copy control 256 which is interposed in the lines 241–247 so that upon being energized by a single replenishment signal, corresponding signals are applied to the output lines 261–267 of a duration sufficient to produce feeding of a total of forty signatures, in the present example, of each type required for the making up of the forty identical replenishment books.

While the circuitry of the plural copy control 256 has not been set forth, the operation of the control is sufficiently straightforward and understood so that specific circuitry is not required. Briefly stated, receipt of a brief replenishment signal on any one of the lines 241–247 is effective to produce a sufficient corresponding and prolonged signal at the respective one of the output lines 261–267 to insure the gathering of the predetermined and adequate number of identical books required for replenishment purposes. By producing "runs" of as many as forty books, the gathering device may operate at a high efficient speed.

Still further in accordance with the present invention the sustained replenishment signals are utilized to set the caliper 40 to a measuring reference level which corresponds to the composition, and hence thickness, of the books being produced. For this purpose the caliper 40 is provided with a caliper limit set device 270 having input control lines connected to lines 261–267, each of which is effective to establish a set of upper and lower reference limits. Means including a mechanical connection 271 are provided for producing a caliper "reading" which is compared to the limits. Thus, by way of example, if an input signal appears at line 261, this establishes upper and lower limits comprising a cerain range of tolerance with which the caliper reading is compared, with a "reject" signal being generated if the reading is outside of tolerance. Similarly, a signal on line 262, corresponding to the gathering of books of specifically different make-up, and corresponding to a second demographic category, will cause the reference settings to shift to a different level corresponding to the thickness of books in the second category with the books outside of tolerance, for such category, again, being rejected.

Where the caliper 40 is physically located close to the gathering device, gathering and setting of the caliper may occur substantially simultaneously without synchronization problems. However, where there is a substantial spacing between the gathering device and caliper, time delay means is preferably interposed in each of the caliper limit set input lines thereby delaying the setting of the caliper until such moment as the books of the particular category begin to arrive at the caliper location. Preferably delay means (for example, in the form of a shift register) is also interposed in line 43 so that out of tolerance books are rejected by rejector 60.

In addition to the gathering of a predetermined number of books of predetermined category in accordance with replenishment signals, means are also provided for opening the gates or diverters of the corresponding storage station to admit the books for replenishment purposes. Thus the solenoids, which control the input gates of the respective storage stations, and which have been designated 81*a*–87*a*, are connected to the gather control means to respond selectively in accordance with the particular version of book being supplied. One convenient way of accomplishing this is to connect the gate solenoids to the respective gather control lines 261–267 so that the same gather control line which initiates production of a series of books serves to open the gate to admit the series of books to the appropriate storage station. For the purpose of insuring that the opening of the gate of the storage station is synchronized with the arrival of the books, delay devices 281–287 are interposed between the gather control means and the gates. The delay devices may be of simple construction, creating a delay equal to transit time.

It will be seen, then, that the automatic replenishment system is in the form of a series of control loops having their beginnings at the outputs of the storage stations and their ends at the inputs of the respective storage stations. Consider a typical cycle: Let it be assumed, for example, that the demand for books from the seventh storage station 97 causes the number of books, as indicated by the storage register 277, to drop below the minimum threshold. This fact is detected by the limit detector 237 so that a signal passes through line 247 into the storage register 255. Provided that the storage register is "clear", the immediately preceding order for books having been satisfied, the ordering signal passes into the plural copy control device 256 so that the signal is converted to one of proper length to produce a desired minimum order of books, for example, forty books. Such order signal then passes into the signature selector matrix via line 267 which energizes selected ones of the lines 254 leading to the signature feeders 14 to produce a book, indeed, a series of books, in the desired demographic version. At the same time the signal on line 267, applied to the caliper limit set device 270, and connection 271, sets the caliper 40 to the appropriate reference level for measuring the thickness of books of the version ordered. Thus the books in the series, arriving on conveyor 11 are checked for alignment by the detector 30, are calipered by the caliper 40, and stitched at the stitching station 50. Provided that the selected signatures are properly alined, and of a total thickness which satisfies the caliper 40, the book will successfully pass the rejecting station 60 and will flow, on the conveyor 65, to the trimmer 70, following which the book, and subsequent books in the series, will make a right angle turn onto the input conveyor 80 of the storage assembly.

Under normal circumstances one of the gates 81–87, under the control of solenoids **81*a*–87*a*, will be open, completing the feeding of a preceding series of books to the appropriate station. However, as the new series of books approaches, the open gate, completing its function, closes, and gate 87 opens in response to the signal on line 267, which initiated production of the series, such signal having been delayed by action of delay device 287 so that opening of the gate 87 by solenoid 87*a* is synchronized with the arrival of the first book in the series. The series of books will, therefore, be dropped from the conveyor 80 onto the pile 110 in station 97 (FIG. 4) until the books in the series have all been fed from the conveyor, following which the gate solenoid 87*a* is turned off, closing the entryway to the storage station. The books on the pile 110 are progressively fed, thereafter, on the storage station conveyor 111 to the dispensing pile or hopper 115 in readiness for feeding onto the conveyor 100**, one by one, upon call from the labeling table.

The threshold level to which the limit detectors 231–237 are set is preferably sufficiently high so that normal orders for books may be filled by the partly depleted station during the time that it takes for a replenishing series to be gathered, processed and deposited in the storage station. Because all gathering occurs in groups for storage replenishment, the groups being formed, say, forty or at least twenty books, switching between versions at the gatherer is minimized and gathering can therefore be done at a high production rate, a rate which is ample to replenish the stations as fast as books can be withdrawn upon instruction from the labeling table. Thus the limiting threshold of the storage registers may be set quite low without risk that a storage station will "run dry". However, it will usually be true, in a practical case, that the several demographic versions will not be equally popular and one or two of such versions may predominate. If desired, means may be provided in the order storage register 255 for giving precendence to the "popular" versions. Orders will normally be processed by the storage register in the order received, but where the order storage register receives an order for replenishment of a popular book and less popular book at the same time, precedence can be given to replenishment of the more popular version.

While it is preferred to utilize the same replenishment, or "gather", control signal to effect opening of the gate at the input of the corresponding storage station, via appropriate time delay, it will be apparent to one skilled in the art that the invention is not limited thereto and that the opening of a gate may be initiated by the books themselves, rather than by the signal which initiated their production, without departing from the present invention. This could be done, for example, by "tagging" each book, or series of books, with its storage station address, with appropriate means, for opening the gate in response to the "tag". For example, the tag could be in the form of a dot on the cover, represented to by a gate-controlling photocell.

In the preferred form of the invention books of predetermined version are called for by coded information appearing on a given one of a series of pre-printed labels fed from a roll. It will be apparent, however, that the invention is not limited to use of pre-printed labels. Instead, the address and associated demographic coding may be stored in the form of a punch card or length of magnetic tape. In such event a printer would be provided right on the labeling table for printing the label "on the spot" and with the associated demographic identification serving to trigger release of a book of appropriate version on which the printer will act. For maximum speed the demographic coding can be "upstream" of the address information for it arrive simultaneously at the printer on the labeling table. Thus the term "label" as used herein is not limited to a physical slip of paper but is more broadly directed toward any medium on which the address information, with associated demographic coding, occurs.

Reference has been made herein to the term "coded" as applied to demographic identification. While use of a binary code is preferred, as set forth in FIGS. 6 and **6*a*, it will be understood tht the term is not limited to an "obscure" display but includes possibility of usage of a visually legible display in which case the reader or scanner 173** will be understood to be capable of reading legible characters, for example ordinary numerals.

The term "labeling table", it will be understood, is a term of art to designate the position in the system where address information is actually applied to the book, whether or not such station is physically in the form of a table.

It may be particularly noted that the assembling and addressing machine is instructed by a series of address labels which are grouped, on a continuous tape, by geographic designation, that is, grouped in accordance with postal zip code. Because the labels are grouped on a geographical basis, it is not possible to group them by demographic category and, as a result, it will frequently be the case that an adjacent succession of labels will be coded for an adjacent succession of demographic categories. The present invention makes it possible for each label to call for, and to be supplied with, a book of desired category for mating, at the labeling table on a continuous and high speed basis. Nevertheless the demographic divisions may, if desired, be of a geographical nature, with the proposed system being capable of furnishing seven different versions of a magazine intended for seven different geographical areas of the country in response to coded instruction on the label. Thus the term "demographic" is intended to be a broad term denoting categories of any kind whatsoever.

To make it easy to understand the control "loops" which characterize the present system and which are in the form of an individual copy address loop and plural copy replenishment loop, circuitry has been set forth in schematic form. The system is highly flexible since the signature selector matrix 250 (FIG. 2) and card selector matrix 220 (FIG. 7) may be in the form of the usual matrix plug board with plugs being insertable at the selected crossing points. It will be understood, however, that in a practical case it will not be necessary to employ the specific circuitry which has been illustrated but it will be found more convenient to set up the control circuitry by patching a "soft wired" computer, that is, by programming a computer to perform the functions which have been described and claimed and such is included within the scope of the present invention.

For example, a computer, in carrying out the invention, may or may not utilize a matrix per se in making the decisions which the system requires. Other types of logic circuitry are available to the computer designer and programmer for making matrixing decisions. The term "matrix" as used herein is therefor used in a generic sense to cover not only the conventional cross-wired or plugboard type of circuitry but any equivalent logic circuitry which might be substituted for a conventional matrix.

We claim as our invention:

1. In an assembling and addressing machine for magazines and the like published in a predetermined plurality of versions corresponding to demographic categories, the combination comprising means for producing a plurality of printed signatures capable upon selection in predetermined combinations of accommodating all of the versions, a gathering device for gathering the selected signatures, gather control means including a matrix for directing the gathering device to select signatures in the predetermined combinations to form a book in any of the versions, binding and trimming means for finishing the gathered book, a storage assembly including a plurality of storage stations each temporarily storing a supply of one version of the finished books corresponding to the respective demographic category, each storage station having an input and an output, an input conveyor for conveying books from the gathering device to the storage assembly, means including diverters controlled by the gather control means for depositing each book produced by the gathering device at the input of the respective storage station, a labeling table, an output conveyor for conveying books from the storage assembly to the labeling table, dispensing means at the output of each storage station for feeding of a book therefrom to the output conveyor, a source of address labels at the labeling table, said labels having the address and coded indication of the demographic category of the recipient, means for effectively reading each label to determine its demographic category, means responsive to the reading means for triggering the dispensing means for the feeding of a book of matching category from the corresponding storage station for conveyance to the labeling table, means at a labeling table for applying the address label to the book of matching category, sensing means associated with each storage station including limit detectors for sensing depletion of books in the station and for producing a depletion signal, and signal-responsive means for controllingly coupling the limit detectors to the gather control means so that a new supply of books of the required version are gathered, bound, trimmed, and deposited in the depleted station to replenish the same.

2. The combination as claimed in claim 1 in which the gather control means includes a plural copy control device having means for causing a number of books of a given version to be produced by the gathering device in response to a single depletion signal.

3. The combination as claimed in claim 2 in which an order storage register is interposed between the limit detectors and the gathering device for receiving simultaneous depletion signals and for causing the gathering device to successively produce groups of similar books of different versions.

4. The combination as claimed in claim 1 in which a delay device is associated with each of the diverters for delaying diversion until arrival of the book at the corresponding diverter.

5. The combination as claimed in claim 1 in which means are provided for delaying application of a label at the labeling table after the reading thereof so that the label arrives at the labeling table for application at the same time as the book which has been dispensed by reading of the label.

6. The combination as claimed in claim 1 in which the means for sensing depletion of books in a station includes an "up" counter at the input of the stations, a "down" counter at the output of the station and a register responsive to the counters for continuously registering the number of books stored in the station with a limit detector for producing a depletion signal when the member in the register falls below a predetermined level.

7. The combination as claimed in claim 1 in which a plurality of card inserting devices are associated with the output conveyor, the address labels having card-insertion data thereon, and a reader for reading the data and coupled to the insertion devices for insertion of cards in each book in predetermined combination.

8. The combination as claimed in claim 1 in which a plurality of card inserting devices are associated with the output conveyor together with means including a matrix responsive to the reading means for signaling the card inserting devices to insert cards in predetermined combination depending upon the demographic category of the book.

9. The combination as claimed in claim 1 in which a caliper is provided adjacent the gathering device for measuring the thickness of a book, a book rejector for rejecting incomplete books, means interposed between the caliper and the rejector for operating the rejector when the thickness of the calipered book does not correspond to the setting of the caliper, means providing demographic identification of each book admitted to the caliper, and means responsive to the demographic identification for adjusting the caliper setting.

10. The combination as claimed in claim 9 in which the gather control means is coupled to the caliper for the purpose of setting the caliper in accordance with the demographic identification of the book being calipered.

11. The combination as claimed in claim 1 in which the input conveyor and the output conveyor are spaced parallel to one another and in which the storage stations are in the form of a plurality of storage conveyor belts spaced parallel to one another and extending laterally from the input conveyor to the output conveyor, the diverters being spaced along the input conveyor for selectively depositing books at the input end of the storage stations, means for driving the conveyors, and a hopper at the output end of each storage station, the dispensing means being arranged to feed a book from the hopper to the output conveyor.

12. In an assembling and addressing machine for magazines and the like published in a predetermined plurality of versions for sending to addresses in corresponding demographic categories, the combination comprising means for producing a plurality of printed signatures capable upon selection in predetermined combinations of accommodating all of the versions, a gathering device for gathering the selected signatures, control means including gather control lines and an associated matrix for directing the gathering device to select signatures in the predetermined combinations to form a book in any of the versions, a storage assembly including a plurality of storage stations, each temporarily storing a supply of one version of the books corresponding to the respective demographic category, each storage station having an input and an output, an input conveyor for conveying books from the gathering device to the storage assembly, means including diverters for depositing each book produced by the gathering device at the input of the respective storage station, a labeling table, an output conveyor for conveying books from the storage assembly to the labeling table, dispensing means at the output of each storage station for feeding of a book therefrom to the output conveyor, a source of address labels at the labeling table, said labels having the address and coded indication of the demographic category of the recipient, with adjacent labels being grouped by zip code, means for effectively reading each label to determine its demographic category, means responsive to the reading means for triggering the dispensing means for feeding of a book of matching category from the corresponding storage station, means at the labeling table for applying the address label to the book of matching category, and means responsive to the number of books in each station for selectively energizing the gather control lines so that all of the stations are replenished when necessary.

13. In an assembling and addressing machine for magazines and the like published in a predetermined plurality of versions for sending to addresses in corresponding demographic categories, the combination comprising means for producing a plurality of printed signatures capable upon selection in predetermined combinations of accommodating all of the versions, a gathering device for gathering the selected signatures, gather control means including a matrix for directing the gathering device to select signatures in the predetermined combinations to form a book in any of the versions, a storage assembly including a plurality of storage stations, each temporarily storing a supply of one version of the books corresponding to the respective demographic category, each storage station having an input and output, an input conveyor for conveying books from the gathering device to the storage assembly, means including diverters controlled by the gather control means for depositing each book produced by the gathering device at the input of the respective storage station, a labeling table, an output conveyor for conveying books from the storage assembly to the labeling table, dispensing means at the output of each storage station for feeding of a book therefrom to the output conveyor, a source of address labels at the labeling table, said labels having the address and coded indication of the demographic category of the recipient, means for effectively reading each label to determine its demographic category, means responsive to the reading means for triggering the dispensing means for feeding of a book of matching category from the corresponding storage station for conveyance to the labeling table, means at the labeling table for applying the address label to the book of matching category, sensing means associated with each storage station including a limit detector for sensing depletion of books in the station and for producing a depletion signal, and means including a plural copy control device responsive to the depletion signal for directing the gather control means to produce books in the version required in a group of predetermined minimum number for depositing in the depleted storage station, thereby reducing the number of times that the gathering device must switch operation between different predetermined combinations of signatures.

14. In an assembling and addressing machine for magazines and the like published in a predetermined plurality of versions for sending to addressees in corresponding demographic categories, the combination comprising means for producing a plurality of printed signatures capable upon selection in predetermined combinations of accommodating all of the versions, a gathering device for gathering the selected signatures, gather control means including a matrix for directing the gathering device to select signatures in such predetermined combinations to form a book in any of the versions, binding and trimming means for finishing the gathered book, a storage assembly including a plurality of storage stations, each temporarily storing a supply of one version of the finished books corresponding to the respective demographic category, each storage station having an input and output, an input conveyor for conveying books from the gathering device to the storage assembly, means including diverters controlled by the gather control means for depositing each book produced by the gathering device at the input of the respective storage station, a labeling table, an output conveyor for conveying books from the storage assembly to the labeling table, dispensing means at the output of each storage station for feeding of a book therefrom to the output conveyor, a source of address labels at the labeling table, said labels having the address and coded indication of the demographic category, means for effectively reading each label to determine its demographic category, means responsive to the reading means for triggering the dispensing means for the feeding of a book of matching category from the corresponding storage station for conveyance to the labeling table, means at the labeling table for applying the address label to the book of matching category, sensing means associated with each storage station including limit detectors for sensing depletion of books in the station and for producing a depletion signal, signal-responsive means for coupling the limit detectors to the gather control means so that a new supply of books of the required version are gathered, bound, trimmed, and deposited in the depleted station to replenish the same, memory type delay devices being interposed between the gather control means and the diverters to produce a delay substantially equal to the transport time on the input conveyor so that books of differing versions can flow on the conveyor in closely spaced succession to the points of respective diversion and in which means are provided for delaying application of a given label at the labeling table after the reading thereof so that the label arrives at its labeling position at the same time as the book which has been triggered by reading of the label.

* * * * *